US007728217B2

(12) United States Patent
Obermeier

(10) Patent No.: US 7,728,217 B2
(45) Date of Patent: Jun. 1, 2010

(54) SOUND GENERATOR FOR PRODUCING A SOUND FROM A NEW NOTE

(75) Inventor: Matthias Obermeier, Gernlinden (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 11/776,414

(22) Filed: Jul. 11, 2007

(65) Prior Publication Data

US 2009/0013858 A1 Jan. 15, 2009

(51) Int. Cl.
*G10H 1/06* (2006.01)

(52) U.S. Cl. ..... 84/622; 84/600; 84/626; 84/659; 84/662

(58) Field of Classification Search ..... None
See application file for complete search history.

(56) References Cited

U.S. PATENT DOCUMENTS 5,357,048 A * 10/1994 Sgroi ..... 84/645

2004/0237758 A1* 12/2004 Bruti et al. ..... 84/609

OTHER PUBLICATIONS

"The Complete MIDI 1.0 Detailed Specification", Version 96.1, Second Edition, Published by the MIDI Manufacturers Association, Los Angeles, CA.

"Scalable Polyphony MIDI", Version 1.0a, Published by the MIDI Manufacturers Association, Los Angeles, CA.

* cited by examiner

*Primary Examiner*—Marlon T Fletcher
(74) *Attorney, Agent, or Firm*—Dickstein, Shapiro, LLP.

(57) ABSTRACT

A sound generator including a plurality of synthesis generators each configured to generate a sound from a note, and a dynamic voice allocation circuit configured to select a new note to be supplied to the plurality of synthesis generators depending on a priority that is associated with the new note and the generated sounds and the volumes of the generated sounds.

21 Claims, 5 Drawing Sheets

SOUND GENERATOR FOR PRODUCING A SOUND FROM A NEW NOTE

TECHNICAL FIELD

Embodiments of the present invention relate generally to a sound generator, to an electronic device, as e.g. a music synthesizer, containing a sound generator and to a method for controlling a sound generator.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
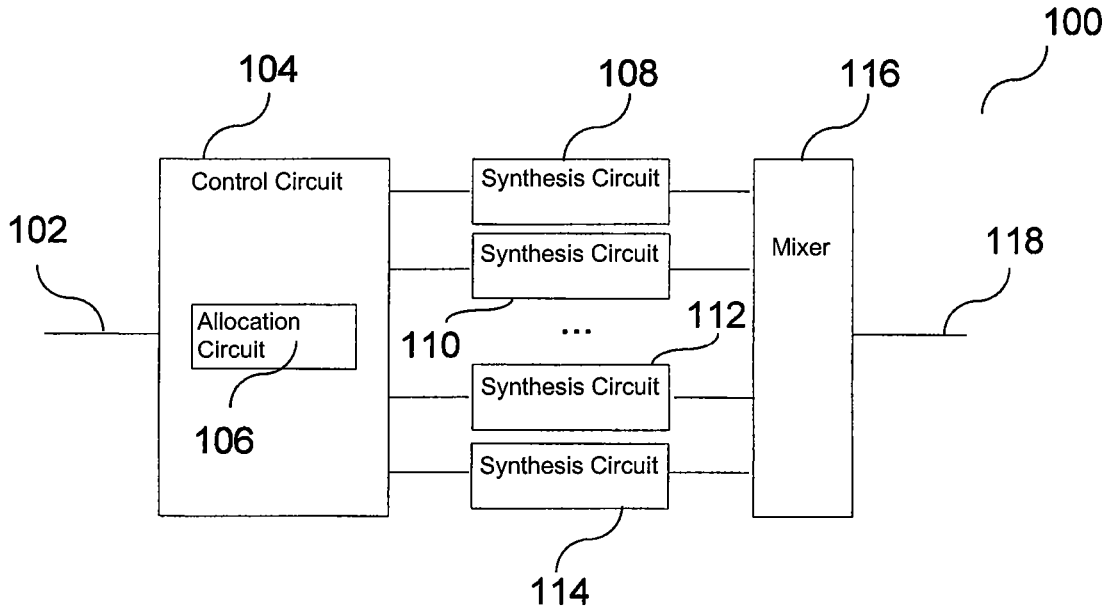
FIG. 1 shows a sound generator according to an embodiment of the invention.

Music synthesizers are to be found in a multiplicity of devices today, like e.g. electronic music instruments, PCs, PDAs (Personal Digital Assistant) and mobile telephones. Their application type reach from the professional production and recording of compositions in the music studio over the interactive background music of computer games up to the generation of ring tones and alarm as well as notification signals. A music synthesizer usually produces an audio signal, which may then be radiated directly over an acoustic transducer (loudspeaker, headphone) from a machine-readable representation of the score of a composition (input data) or which is stored on a suitable recording medium for the later playback. As a format for the synthesizer input data, the MIDI (Musical Instrument Digital Interface) format became generally accepted.

A substantial characteristic of a synthesizer is the maximum number of voices, which the synthesizer can produce at the same time (voice number; in the literature also the term "polyphony" is used frequently). This corresponds to the maximum number of tones (notes), which can sound at the same time. The maximum voice number of MIDI files depends on the complexity of the arrangement and is not standardized. Thus, the case can occur at any time that the input data require more voices, than the synthesizer can render. For this reason a synthesizer contains generally a functional module for dynamic voice allocation, whose task is to map the notes requested in the input data to the existing voices. The complexity of synthesizers rises linearly with the maximum voice number. Since particularly in mobile devices resources available for the synthesizer are extremely limited (small arithmetic performance, limited battery capacity), it is desirable to optimize the dynamic voice allocation in such a way that also with a small voice number still the optimum sound quality is reached (e.g. no audible dropouts in the melody). This gains e.g. in importance when the synthesizer works with a variable voice number, and thus only a very small voice number is available in certain operating conditions.

Therefore, a method, a sound generator, and an electronic device are desired producing a sound from a new note in an environment with a limited maximum voice number avoiding negative effects on the listener's perception in the case when the limit is already reached.

Embodiments of the invention described in the following provide a sound generator, an electronic device containing a sound generator and a method for controlling a sound generator for generating a sound from a note using priority information of the sounds and volume information solely of the already generated sounds. Implementations of embodiments of the invention allow for a dynamic voice allocation at minimum expenditure and achieve a full acoustic pattern without audible artifacts, already with small voice numbers.

If all voices of a synthesizer are occupied already but a further note is to be triggered, there are two possibilities:

a) The note which shall be triggered newly is ignored, i.e. it is not triggered.

b) A voice already sounding is overloaded, i.e. a tone already sounding is cut off and replaced by the new note.

Conventionally, in order to decide between both alternatives, typically the expected volume of the new note is consulted. If it comes to overloading a voice, usually the oldest sounding tone is selected.

This has several effects: on the one hand, it requires substantial expenditure to compute the expected volume from the MIDI data of a note which is to be triggered. On the other hand, the oldest sounding voice is not by any means always the least important one in the musical context. A very descriptive counter example is e.g. a so-called organ point (loud tone in the bass, which remains lying over many measures). Beyond that, the determination of the oldest tone requires extensive data retention in the voice administration (e.g. linked list) which is reflected in both the memory and the cost of computation. Conventional dynamic voice allocations that are implemented according to this principle require therefore substantially more resources and achieve a clearly decreased sound quality, particularly with small voice numbers.

According to an embodiment of the invention, an algorithm for dynamic voice allocation described in the following uses for the decision, whether and which voice is to be overloaded solely the current volume of the voices already sounding as well as the channel priority of the new note and the voices already sounding. The volume of all voices already sounding is known internally if the synthesizer is suitably implemented; and can therefore be determined by a simple inquiry. The channel priority in accordance with an embodiment of the invention may be defined in the context of the MIDI standards, and is either fixed (GM1, GM2; General MIDI) or variable (SP-MIDI; Scalable Polyphony MIDI), but at runtime at any time well-known. The fundamental idea thereby is that the author of a MIDI file specifies himself which notes or instruments, respectively, are particularly important in the current musical context, and therefore should not be overloaded under any circumstances.

The algorithm may be implemented on dedicated electrical components or on a standard processing hardware having one or more microprocessors or programmable devices such as e.g. FPGAs (Field Programmable Gate Arrays) and usual hardware devices such as e.g. memories, driver circuits, etc., interfacing the programmable devices.

The algorithm may e.g. be implemented as a configuration as shown in FIG. 1, which illustrates in an embodiment of the invention a sound generator 100 having a plurality of synthesis generators 108, 110, 112, 114 to generate a sound from a new note; a dynamic voice allocation circuit 106; the dynamic voice allocation circuit 106 being configured to select a new note to be supplied to the plurality of synthesis generators 108, 110, 112, 114 depending on the volumes of the generated sounds.

Figure 3:
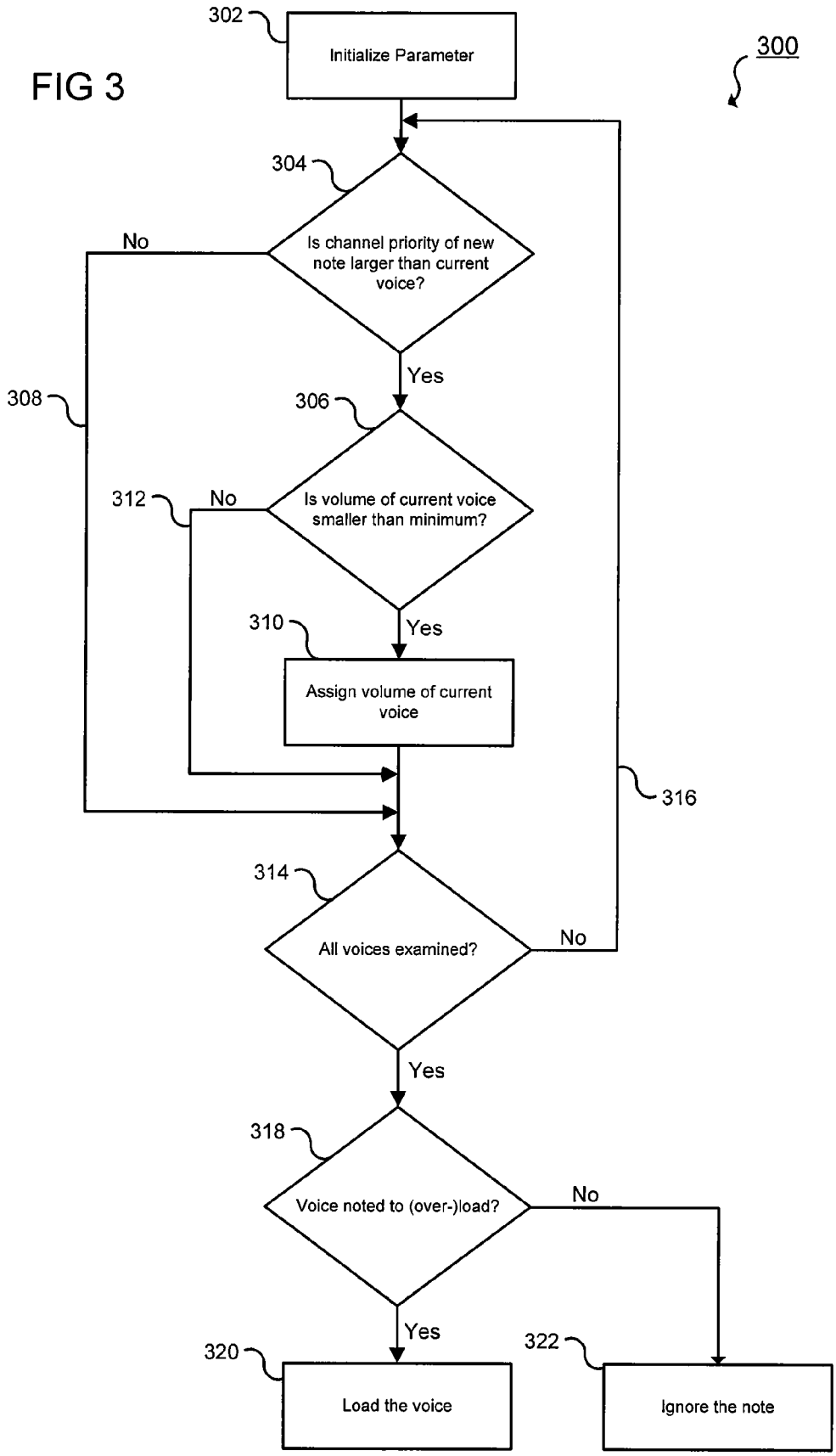
FIG. 3 shows a flow diagram illustrating a method according to an embodiment of the invention.

A sound generator control circuit 104 controls and monitors the entire sound generator. The sound generator control circuit 104 provides all the parameters for the synthesis generators when a new note is to be triggered. The dynamic voice allocation circuit 106 is called by the sound generator control circuit when a new note is to be processed (i.e. due to a MIDI Note On) and takes care of assigning notes to generators. The dynamic voice allocation circuit 106 further implements the control flow which is described in more detail further below and in FIG. 3.

The new note is represented in FIG. 1 by means of the input data 102.

In a further embodiment, the sound generator 100 contains a plurality of synthesis generators 108, 110, 112, 114 to generate a sound from a note; a dynamic voice allocation circuit 106; wherein the dynamic voice allocation circuit 106 is configured to select a new note to be supplied to the plurality of synthesis generators 108, 110, 112, 114 depending on a priority that is associated with the new note and the generated sounds and the volumes of the generated sounds.

In an embodiment, at least some of the plurality of synthesis generators 108, 110, 112, 114 are coupled to the dynamic voice allocation circuit 106 to supply the volumes of the generated sounds to the dynamic voice allocation circuit 106.

FIG. 1 further shows an embodiment, in which a mixer 116 is coupled to the outputs of the plurality of synthesis generators 108, 110, 112, 114 to mix the generated sounds to an audio signal 118.

In an embodiment of the invention, the sound generator 100 is contained in an electronic device.

In an embodiment, the electronic device is an electronic device selected from a group of electronic devices consisting of a synthesizer, a sound card, a sound sampler, a sound effect device, a PC, a PDA, a mobile phone, or a game console.

Figure 2:
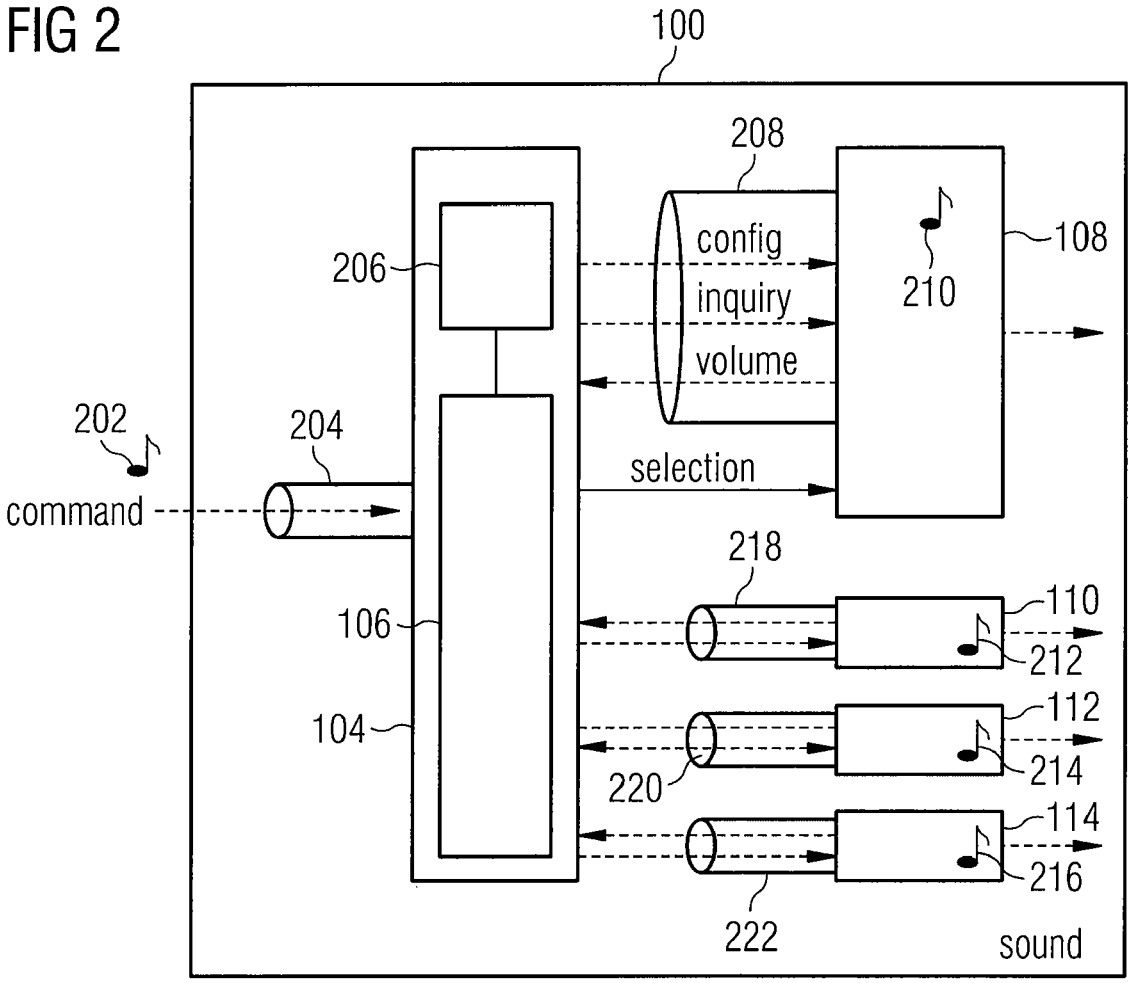
FIG. 2 shows the internal data flow of a sound generator according to an embodiment of the invention.

FIG. 2 shows an example of the signal flow in the sound generator 100. Note 202 is sent with a command through the channel 204 with a pre-defined priority to the sound generator control circuit 104 which calls the dynamic voice allocation circuit 106. The volume of note 202 can be calculated as an expected volume which may be used as one of the input data for the dynamic voice allocation circuit 106. As long as there are free synthesis generators 108, 110, 112, 114, the dynamic voice allocation circuit 106 selects a free synthesis generator 108, 110, 112, 114 to be used for the new note 202 according to the commanded properties of the new note 202. Otherwise, the configuration is dependent on the evaluation of the algorithm according to an embodiment of the invention inside the dynamic voice allocation circuit 106. As shown exemplarily for channel 208, the dynamic voice allocation circuit 106 sends an inquiry to the synthesis generators 108, 110, 112, 114, which send as response a signal that contains information about the volume of the actually generated sound to the dynamic voice allocation circuit 106 through the channels 208, 218, 220, 222 which also have a defined priority. The dynamic voice allocation circuit 106 selects according to the algorithm one of the synthesis generators 108-114, in FIG. 2, for example, the synthesis generator 108, and instructs the sound generator control circuit to send the configuration data according to the new note to the selected sound generator 108. As described above, the output signals 210, 212, 214, 216 are mixed in a mixer 116 to an audio signal 118, which is not shown in FIG. 2.

FIG. 2 shows a channel 208 as an example for all channels between the synthesis generators 108, 110, 112, 114 and the sound generator control circuit 104. The number of channels and synthesis generators 108, 110, 112, 114, respectively, is not standardized or fixed. Thus, in an embodiment of the invention, an arbitrary number of channels and syntheses generators 108, 110, 112, 114 may be provided. In an embodiment of the invention, there are more channels in a sound generator as shown in FIG. 2. Note: The "selection" arrow does not represent a data or control connection, but shall indicate that the dynamic voice allocation circuit 106 has selected a first synthesis generator 108 for generating a sound from a new note 202.

In an embodiment of the invention, the volume and priority information of the notes 210, 212, 214, 216 is stored in a memory 206. This ensures an easy access to the needed information for the dynamic voice allocation circuit 106 and enables the determination and selection processes for a generated note 210 to be replaced by a new note 202 using a list, as will be explained in more detail further below.

In an embodiment of the invention, the dynamic voice allocation circuit 106 is configured to determine one or a plurality of notes 210, 212, 214, 216 of a generated sound having a priority within a predefined priority range with respect to the priority that is associated with the new note 202, and to select a determined note 210 of a generated sound to be replaced by the new note 202 depending on the volumes of the determined notes 210, 212, 214, 216 of the generated sounds.

In an embodiment of the invention, the dynamic voice allocation circuit 106 is configured to determine one or a plurality of notes 210, 212, 214, 216 of a generated sound having a priority equal to or lower than the priority that is associated with the new note 202, and to select a determined note 210 of a generated sound to be replaced by the new note 202 depending on the volumes of the determined notes 210, 212, 214, 216 of the generated sounds.

In an embodiment of the invention, the dynamic voice allocation circuit 106 is configured to determine an expected volume of the new note 202 and to select a determined note 210 of a generated sound to be replaced by the new note 202 depending on the volumes of the determined notes 210, 212, 214, 216 of the generated sounds and the expected volume of the new note 202.

In an embodiment of the invention, the volume of a generated sound is represented by the amplitude of the signal of the generated sound.

The current amplitude is a very simple criterion for the decision. For all synthesis methods that work internally with envelope generators (e.g. FM (Frequency Modulation) or wave table synthesis) a further simplification is possible by returning only the current value of the amplitude envelope, so that in an implementation the volume of a generated sound is represented by the current amplitude envelope generator output.

A condition for the suggested algorithm is the presence of a list, that may be a table that contains the current volume and the channel priority for all voices.

In an embodiment of the invention, the notes 210, 212, 214, 216 of the generated sounds are stored in a list, wherein the list contains for each generated sound the priority of the corresponding note and the volume of the respective generated sound.

The volume of each generated sound may vary over time. Therefore, in an embodiment, the volume entries in the list are updated either regularly or on demand when a new note is to be triggered in order to ensure that the latest volume of the generated sound is considered for the generator selection process.

In an embodiment of the invention, the list is stored in a memory 206 of the sound generator.

The memory in FIG. 2 is logically associated to the sound generator control circuit 104. However, the memory may physically be located anywhere inside the sound generator 100 or be part of the electronic devices, as e.g. an FPGA of the sound generator.

The processes of determining a note 210 that is suitable to be replaced by the new note 202 will be explained in more detail below. The processes use the list with the priority and volume information of the generated sounds and use a minimum volume parameter storing the minimum volume of the current note that has been regarded so far in the determination process.

As could be seen from FIGS. 1 and 2, the implementation of a synthesizer can be done separately in two parts: a dynamic voice allocation circuit 106 which is implemented in the sound generator control circuit 104, and a set of synthesis generators 108, 110, 112, 114.

The dynamic voice allocation circuit 106 reads and interprets the input data (e.g. MIDI commands), implements the dynamic voice allocation (the notes which can be triggered are assigned to the existing synthesis generators 108, 110, 112, 114) and configures this accordingly. Each synthesis generator 108, 110, 112, 114 produces an output signal 210, 212, 214, 216 of a voice.

Embodiments of the invention require only a minimum extension of the architecture. The synthesis generators 108, 110, 112, 114 acknowledge the current volume to the dynamic voice allocation circuit 106 on request. Since the generators 108, 110, 112, 114 produce the output signal 210, 212, 214, 216 of a voice directly, the derivative and return of the current volume are possible on the basis of a suitable criterion generally without substantial additional expenditure.

Thus, the additional expenditure reduces to the provision of an additional interface between the dynamic voice allocation circuit 106 and the synthesis generators 108, 110, 112, 114. With the triggering of a new note 202 the algorithm then proceeds for dynamic voice allocation as described in the following by means of the flow diagram 300 depicted in FIG. 3.

In 302, the flow control begins with the first voice. A parameter which indicates the minimum volume of the notes 108, 110, 112, 114 is initialized with the maximally possible volume.

In 304, the channel priority is determined. If the channel priority of the new note is larger than that of the current voice 306 is executed next, otherwise path 308 is followed, and the process continues with 314.

In 306, the volume of the current voice is determined. If the volume of the current voice is smaller than the minimum found so far 310 is executed next, otherwise path 312 is followed and the process continues with 314.

In 310, the volume of the current voice is assigned to the parameter containing the minimum volume: Found minimum=volume of the current voice. Furthermore, the current voice is marked to be a candidate for (over-) loading.

In 314, it is determined if all voices were examined. If all voices were examined ("Yes" in 314), 318 is executed next, otherwise ("No" in 314), the next voice is selected and the process continues with 304.

In 318, it is determined, if a voice was noted to (over-) load. If a voice was noted to (over-) load ("Yes" in 318), the process continues with 320 loading the voice, otherwise ("No" in 318), the process continues with 322 ignoring the note.

If a new note has been loaded in 320 the list is updated accordingly. Thus, in an embodiment of the invention, the dynamic voice allocation circuit 106 is configured to fill the list at least partially in a successive manner note by note.

In an embodiment, the voice allocation circuit 106 is configured to initialize the list with the volume parameters of all generators set to 0 and the priorities set to the lowest level.

An implementation of an embodiment of the invention according to the flow control 300 described above is illustrated in the following.

In an embodiment of the invention, for a new note 202 to be inserted into the list, the following processes are carried out a) initialize a minimum volume parameter to the maximum possible volume;

b) select a note from the list; e.g. note 210;

c) determine, whether the priority of the new note 202 to be inserted into the list is higher than the priority of the selected note 210;

d) in case that the priority of the new note 202 to be inserted into the list is higher than the priority of the selected note 210, determine, whether the volume of the generated sound of the selected note 210 is smaller than the minimum volume parameter value;

e) in case that the volume of the generated sound of the selected note 210 is smaller than the minimum volume parameter value, mark the selected note as being a replacement candidate;

f) in case that the volume of the generated sound of the selected note 210 is not smaller than the minimum volume parameter value, determine, whether all notes of the list have been processed;

g) in case that the priority of the new note 202 to be inserted into the list is lower than or equal to the priority of the selected note 210, determine whether all notes 210, 212, 214, 216 of the list have been processed;

h) In case a selected note 210 has been marked as being a replacement candidate, replace the marked selected note 210 by the note 202 to be inserted into the list.

In an embodiment, the notes 202, 210, 212, 214, 216 are encoded in accordance with a musical instrument digital interface standard.

In the following, methods are described that represent the algorithm implemented on the sound generator 100 in accordance with embodiments of the invention.

Figure 4:
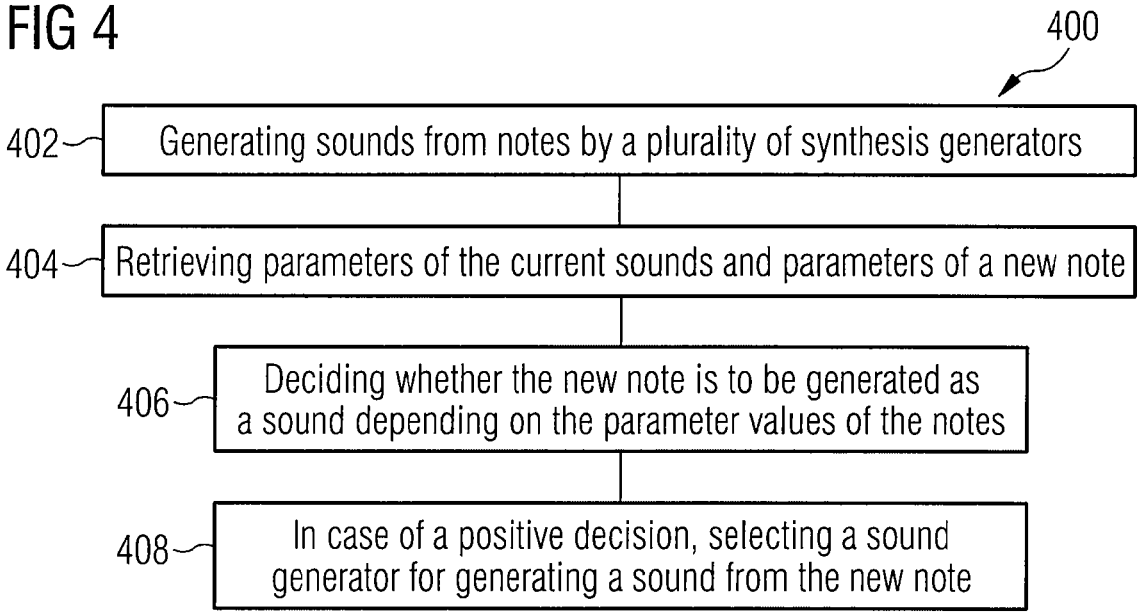
FIG. 4 shows a method for generating a sound according to an embodiment of the invention.

In an embodiment of the invention, a method for generating a sound from a note is provided. As depicted in FIG. 4 and previously discussed FIG. 2, in 402, sounds are generated by a plurality of synthesis generators from notes 210, 212, 214, 216. In 404, parameters of the current sounds and parameters of a new note 202 are retrieved or determined. In 406, a decision is made as to whether the new note 202 is to be generated as a sound depending on the parameter values of the notes 202, 210, 212, 214, 216. In 408, in case of a positive decision, a sound generator is selected for generating a sound from the new note 202.

In an embodiment of the invention, the parameters are the volume of the generated sounds and the priority of the notes 202, 210, 212, 214, 216.

These parameters are usually known in the sound generator 100 and easy to access for the dynamic voice allocation circuit 106.

In a further embodiment of the invention, a parameter is the expected volume of the new note 202. Then, according to this embodiment, one or a plurality of determined notes 210, 212, 214, 216 of a generated sound is selected to be replaced by the new note 202 depending on the volumes of the determined notes 210, 212, 214, 216 of the generated sounds and the expected volume of the new note 202.

In an embodiment, the input parameters are the current volume of all generators, the expected volume of the new note and the priority of all notes and one or a plurality of determined notes of a generated sound is selected to be replaced by the note depending on the current volume of all generators, the expected volume of the new note and the priority of all notes.

In an embodiment, the volume of a generated sound is represented by the current amplitude envelope generator output.

In an embodiment of the invention, the selection of a synthesis generator 108, 110, 112, 114 is based on the determination of one or a plurality of notes 210, 212, 214, 216 of a generated sound having a priority within a predefined priority range with respect to the priority that is associated with the new note 202, and a selection of a determined note of a generated sound to be replaced by the new note 202 depending on the volumes of the determined notes of the generated sounds.

The priority range may e.g. extend from the lowest priority to the priority of the new note 202.

In an embodiment of the invention, the selection of a synthesis generator 108-114 is based on the determination of one or a plurality of notes 210, 212, 214, 216 of a generated sound having a priority equal to or lower than the priority that is associated with the new note 202, and a selection of a determined note of a generated sound to be replaced by the new note 202 depending on the volumes of the determined notes of the generated sounds.

In an embodiment of the invention, the new note is ignored if the decision whether the new note is to be generated is negative.

In an embodiment of the invention, the volume of a generated sound is represented by the amplitude of the signal of the generated sound.

In an embodiment of the invention, the generated sounds are mixed to an audio signal. The audio signal may be amplified and sent to a loudspeaker or it may be processed in further subsequent stages.

In order to determine the parameter values, a list may be used. The list may be a kind of table.

In an embodiment of the invention, the notes 210, 212, 214, 216 of the generated sounds are stored in the list. According to this embodiment, the list may contain for each generated sound the priority of the corresponding note and the volume of the respective generated sound.

In a further embodiment of the invention, the list may be filled at least partially in a successive manner note by note.

In an embodiment, the voice allocation circuit 106 is configured to initialize the list with the volume parameters of all generators set to 0 and the priorities set to the lowest level.

In an embodiment of the invention, for a new note 202 to be inserted into the list the following processes are carried out a) initialize a minimum volume parameter to the maximum possible volume;

b) select a note 210 from the list;

c) determine, whether the priority of the new note 202 to be inserted into the list is higher than the priority of the selected note 210;

d) in case that the priority of the new note 202 to be inserted into the list is higher than the priority of the selected note 210, determine, whether the volume of the generated sound of the selected note 210 is smaller than the minimum volume parameter value;

e) in case that the volume of the generated sound of the selected note 210 is smaller than the minimum volume parameter value, mark the selected note as being a replacement candidate;

f) in case that the volume of the generated sound of the selected note 210 is not smaller than the minimum volume parameter value, determine, whether all notes of the list have been processed;

g) in case that the priority of the new note 202 to be inserted into the list is lower than or equal to the priority of the selected note 210, determine, whether all notes of the list have been processed;

h) in case a selected note has been marked as being a replacement candidate, replace the marked selected note by the new note 202 to be inserted into the list.

In an embodiment, the value of the volume parameter of the sound of a free synthesis generator 108, 110, 112, 114 is set to zero and the priority of the note parameter of the free synthesis generator is set to the lowest priority. That is, free voices (voices that currently produce no tone) are marked therein by volume 0 and the lowest channel priority. Every time a new note 202 is to be triggered, from this list the one with minimum volume (minimum search) is determined in only one passage. Only voices are considered, whose channel priority is smaller than the priority of the note which is newly to be triggered. It does not even need to be differentiated by this generic approach whether voices are still free, or whether all voices are occupied already: as long as free voices are present, these are found automatically due to the minimum volume and channel priority. As soon as no free voices are present any more the channel priority decides whether the new note 202 is triggered or ignored: only notes with higher channel priority can lead to overloading a voice. The selection of the voice which can be overloaded takes place finally on the basis of the minimum volume. All three distinctions by cases (free voices available or not, ignoring the new note or overloading a voice and selection of the voice to be overloaded) are accomplished implicitly with only one search procedure over the list of all voices.

For sounds with a sufficiently short attack phase even immediate overloading of voices (the currently sounding tone is cut off immediately and the new note is triggered immediately) does not lead to audible noise, since the clicking noise produced due to abrupt cutting off is masked by the transients of the newly triggered note.

In an embodiment, the replacement of the note is accomplished by immediately cutting off the currently generated sound.

In an embodiment of the invention, the replacement of the note 210 is accomplished by fading out the generated sound. In order to reduce the generation of audible artefacts due to the note replacement further it is possible, not to simply switch off the generator 108 which is to be overloaded but to fade out its output signal over some milliseconds. As a consequence, however, the new note 202 is not triggered immediately, but with minor delay. In a favorable way the synthesis generators 108, 110, 112, 114 are implemented in such a way that the loading of a new parameter set (the parameter set determines the sound, thus the instrument, which a generator produces) and starting of a new note 202 (with the existing parameter set) can be triggered independently from each other by the dynamic voice allocation circuit 106. Loading of a new parameter set is generally by far more extensive, than a starting of a new note 202.

In an embodiment of the invention, a sound generation parameter set is loaded independently from the sound generation of the new note 202.

In an embodiment it is examined, which sound generators are loaded with a suitable sound generation parameter set and wherein, when determining the note with the minimum volume, the determination process is stopped when a note was found with a suitable sound generation parameter set and a volume that is lower than or equal to the minimum volume found so far. In order to achieve a further complexity reduction, it is beneficial to minimize the number of the loading procedures. This is reached by preferring generators, which are loaded with the correct parameter set already when triggering a new note 202. That can also be realized by a simple extension with the suggested algorithm: For that purpose, in process 3, it is firstly examined whether the current voice is loaded with the suitable parameter set already. If yes, the current voice is already noted for overloading if its volume is smaller than or equals the minimum found so far. If no, further the criterion "smaller than the current minimum" is used.

As soon as several voices with minimum volume are present, this causes that in an embodiment of the invention, voices are selected, which are already correctly parameterized. This includes in particular the case that still free voices are present (=several voices with the minimum volume 0). By examining only one single further condition in the voice administration a further substantial complexity reduction is obtained.

In an embodiment of the invention, the notes are encoded in accordance to a musical instrument digital interface standard.

Figure 5:
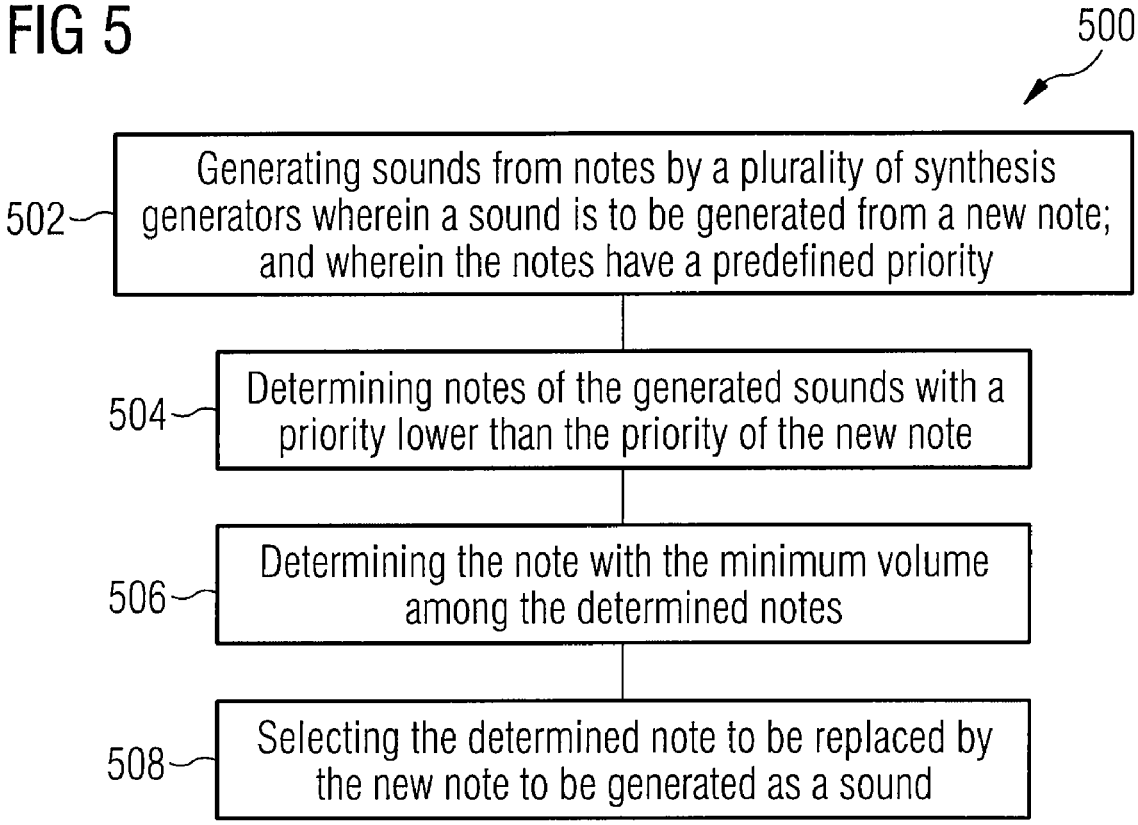
FIG. 5 shows a method for generating a sound from a note using priority and volume information according to an embodiment of the invention.

In an embodiment of the invention, a method 500 for generating a sound from a note is provided. FIG. 5 illustrates this embodiment. In 502, sounds are generated from notes by a plurality of synthesis generators wherein a sound is to be generated from a new note and wherein the notes have a predefined priority. In 504, notes of the generated sounds with a priority lower than the priority of the new note are determined. In 506, among the determined notes the note with the minimum volume is determined, and in 508, the determined note is selected to be replaced by the new note to be generated as a sound.

Figure 6:
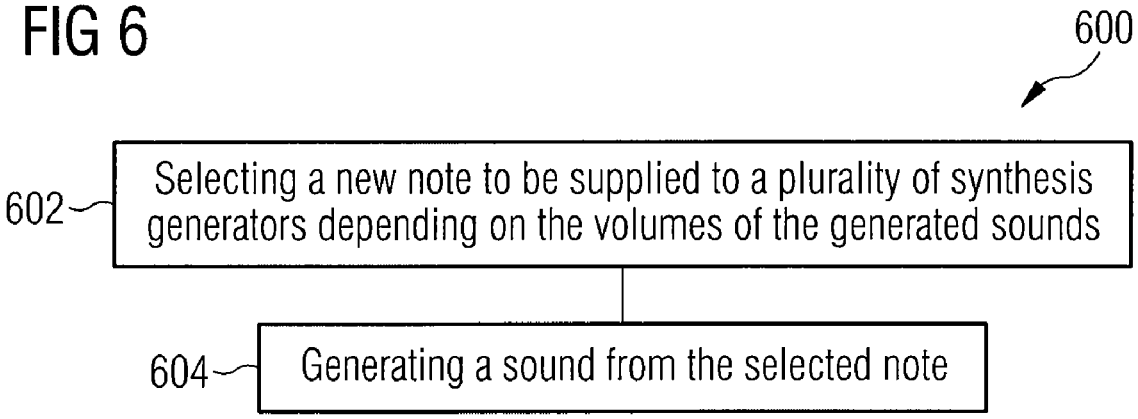
FIG. 6 shows a further method for generating a sound from a note using volume information according to an embodiment of the invention.

In a further embodiment of the invention, which is shown in FIG. 6, a method 600 for generating a sound from a note is provided, wherein in 602 a note is selected to be supplied to a plurality of synthesis generators depending on the volumes of the generated sounds and in 604 a sound is generated from the note.

In an embodiment of the invention, an expected volume of the note is determined and a determined note of a generated sound is selected to be replaced by the note depending on the volumes of the notes of the generated sounds and the expected volume of the note.

In an embodiment of the invention, the volume of a generated sound is represented by the amplitude of the signal of the generated sound.

In an embodiment, the volume of a generated sound is represented by the current amplitude envelope generator output.

In an embodiment of the invention, the sum of the output signals of all generators results in the desired audio signal. Thus, in this embodiment, the generated sounds are mixed to an audio signal. In an embodiment, the mixing of the output signal is performed by a mixer.

The implementation allows for a dynamic voice allocation at minimum expenditure and may achieve a full acoustic pattern without audible artifacts, already with voice numbers starting from approximately 10, which practically cannot be differentiated from comparable implementations with a clearly higher voice number by the listener.

In an embodiment of the invention, the algorithm consists of a search only extended by the volume minimum over all voices in comparison to known techniques. If a suitable voice is found, this is overloaded, if not, the new note which is to be triggered is ignored.

As a consequence, on the one hand, the complexity is low: only inquiries of internally already existing data, only a simple minimum search, and no complex data structures and no extensive computation of the expected volume of the new note is necessary. On the other hand, this approach achieves also an outstanding sound quality: by the combination of the volume of the sounding voices with the channel priority both the perception of the listener (only the quietest, and thus the at least audible tone is overloaded) and the intention of the author (musically important voices are never overloaded with more unimportant voices) are accommodated.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for generating a sound from a new note, comprising:

generating sounds from notes by a plurality of synthesis generators;

retrieving parameters of the current sounds and parameters of the respective notes;

comparing the parameters of the current notes with parameters of a new note;

deciding, based on the comparison of parameters, whether the new note is to be generated as a sound; and in case of a positive decision, selecting one of the plurality of synthesis generators to generate a sound from the new note depending on the parameters of the sounds.

2. The method according to claim 1, wherein the parameters are the volume of the generated sounds and the priority of the notes.

3. The method of claim 1, wherein an input parameter of the parameters of the notes is the expected volume of the new note, and wherein the method further comprises selecting one or a plurality of determined notes of a generated sound to be replaced by the new note depending on the volumes of the determined notes of the generated sounds and the expected volume of the new note.

4. The method of claim 1, wherein the parameters are the current volume of all synthesis generators, and wherein the method further comprises selecting the expected volume of the new note and the priority of all notes and one or a plurality of determined notes of a generated sound to be replaced by the note depending on the current volume of all synthesis generators, the expected volume of the new note and the priority of all notes.

5. The method of claim 2, wherein the volume of a generated sound is represented by the amplitude of the signal of the generated sound.

6. The method claim 2, wherein the volume of a generated sound is represented by the current amplitude envelope generator output.

7. The method of claim 2, wherein the value of the volume parameter of the sound of a free synthesis generator is set to zero and the priority of the note parameter of the free synthesis generator is set to the lowest priority.

8. The method of claim 1, further comprising mixing the generated sounds to an audio signal.

9. The method of claim 1, wherein the selection of the synthesis generator is based on a determination of at least one note of a generated sound having a priority within a predefined priority range with respect to the priority that is associated with the note, and selection of a determined note of a generated sound to be replaced by the new note is based on the volumes of the determined notes of the generated sounds.

10. The method of claim 1, wherein the selection of the synthesis generator is based on a determination of at least one note of a generated sound having a priority lower than the priority that is associated with the new note, and selection of a determined note of a generated sound to be replaced by the new note is based on the volumes of the determined notes of the generated sounds.

11. The method according to claim 1, further comprising ignoring the new note if the decision whether the new note is to be generated is negative.

12. The method according to claim 1, further comprising replacing the current note with a new note by immediately cutting off the currently generated sound.

13. The method according to claim 1, further comprising replacing the current note with a new note by fading out the generated sound.

14. The method of claim 1, further comprising storing the notes of the generated sounds in a list, wherein the list comprises for each generated sound the priority of the corresponding note and the volume of the respective generated sound.

15. The method of claim 14, wherein the list is filled at least partially in a successive manner note by note.

16. The method of claim 14, wherein the volume entries in the list are updated either regularly or on demand when a new note is to be triggered in order to ensure that the latest volume of the generated sound is considered for the generator selection process.

17. The method of claim 15, wherein the list is initialized with volume 0 and minimum priority for all generators.

18. The method of claim 17, furthering comprising inserting a new note into the list by:

initializing a minimum volume parameter to the maximum possible volume;

selecting a note from the list;

determining whether the priority of the new note to be inserted into the list is higher than the priority of the selected note;

in case that the priority of the note to be inserted into the list is higher than the priority of the selected note, determining whether the volume of the generated sound of the selected note is smaller than the minimum volume parameter value;

in case that the volume of the generated sound of the selected note is smaller than the minimum volume parameter value, marking the selected note as being a replacement candidate and update the minimum volume parameter accordingly;

in case that the volume of the generated sound of the selected note is not smaller than the minimum volume parameter value, determining whether all notes of the list have been processed;

in case that the priority of the note to be inserted into the list is lower than or equal to the priority of the selected note, determining whether all notes of the list have been processed; and in case a selected note has been marked as being a replacement candidate, replacing the marked selected note by the note to be inserted into the list.

19. The method of claim 1, wherein the notes are encoded in accordance to a musical instrument digital interface standard.

20. The method of claim 1, wherein a sound generation parameter set is loaded independently from the sound generation of the new note.

21. The method of claim 20, further comprising:

examining which synthesis generators are loaded with a suitable sound generation parameter set; and when determining the note with the minimum volume, stopping the determination process when a note is found with a suitable sound generation parameter set and a volume that is lower than or equal to the minimum volume found so far.

* * * * *

UNITED STATES PATENT AND TRADEMARK OFFICE

CERTIFICATE OF CORRECTION

PATENT NO. : 7,728,217 B2
APPLICATION NO. : 11/776414
DATED : June 1, 2010
INVENTOR(S) : Matthias Obermeier It is certified that error appears in the above-identified patent and that said Letters Patent is hereby corrected as shown below:

At column 11, line 4, in Claim 6, delete "method" and insert -- method of --, therefor.

At column 12, line 3, in Claim 18, delete "furthering" and insert -- further --, therefor.

Signed and Sealed this

Fourteenth Day of September, 2010

David J. Kappos

David J. Kappos
*Director of the United States Patent and Trademark Office*